US008000640B2

(12) United States Patent
Tabata et al.

(10) Patent No.: US 8,000,640 B2
(45) Date of Patent: Aug. 16, 2011

(54) IMAGE FORMING APPARATUS

(75) Inventors: Eiji Tabata, Ibaraki (JP); Masahiko Matsuura, Suita (JP); Keiko Momotani, Ibaraki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 345 days.

(21) Appl. No.: 11/901,432

(22) Filed: Sep. 17, 2007

(65) Prior Publication Data

US 2008/0069579 A1 Mar. 20, 2008

(30) Foreign Application Priority Data

Sep. 19, 2006 (JP) ..... 2006-252471
Oct. 27, 2006 (JP) ..... 2006-292371
Oct. 27, 2006 (JP) ..... 2006-292372

(51) Int. Cl.
*G03G 15/16* (2006.01)

(52) U.S. Cl. ..... 399/296; 399/45; 399/389

(58) Field of Classification Search ..... 399/38, 399/45, 53, 66, 237, 239, 260, 381, 388, 399/389, 296

See application file for complete search history.

(56) References Cited

U.S. PATENT DOCUMENTS 5,140,375 A * 8/1992 Shindo et al. ..... 399/45
5,296,903 A * 3/1994 Suzuki et al. ..... 399/66
5,848,323 A * 12/1998 Umeda et al. ..... 399/66
5,905,925 A * 5/1999 Kawabata et al. ..... 399/45
6,115,576 A 9/2000 Nakano et al.
6,766,123 B2 7/2004 Ebihara et al.
2002/0018675 A1* 2/2002 Akema et al. ..... 399/320
2004/0005407 A1* 1/2004 Takeuchi et al. ..... 427/240
2004/0165203 A1* 8/2004 Lindig ..... 358/1.12

FOREIGN PATENT DOCUMENTS

JP 08-297418 11/1996
JP 09-244437 9/1997
JP 09-304979 11/1997
JP 09-329971 12/1997
JP 09-329972 12/1997

* cited by examiner

*Primary Examiner* — David Porta
*Assistant Examiner* — Benjamin Schmitt
(74) *Attorney, Agent, or Firm* — Brinks Hofer Gilson & Lione

(57) ABSTRACT

An image forming apparatus includes a section for obtaining a property of a recording material; an adjusting section for adjusting a toner amount of a toner image formed by development depending on the property of the recording material; a charging section for charging the toner image before transfer; and a controlling section for adjusting a charging quantity by the charging section depending on the toner amount, where an appropriate quantity of charge depending on the toner amount is provided to the toner image before transfer to the recording material. Depending on the property of the recording material, an appropriate toner amount is transferred at a high transfer efficiency, and uniformity of a solid concentration is ensured.

13 Claims, 6 Drawing Sheets

IMAGE FORMING APPARATUS

This application is based on Japanese Patent Application No. 2006-252471 filed on Sep. 19, 2006, No. 2006-292371 filed on Oct. 27, 2006, No. 2006-292372 filed on Oct. 27, 2006, in Japanese Patent Office, the entire content of which is hereby incorporated by reference.

TECHNICAL FIELD

The present invention relates to an image forming apparatus for developing an electrostatic latent image on an image supporting member by a liquid developer and transferring a formed toner image onto a recording material.

BACKGROUND

Conventionally, an image forming apparatus for developing an electrostatic latent image on the surface of an image supporting member with a liquid developer including toner particles dispersed in an insulating carrier liquid, transferring a toner image formed by development onto a recording material, thereby obtaining a final image is known. Further, an image forming apparatus for transferring primarily a toner image formed on an image supporting member by development with a liquid developer onto an intermediate transfer medium, superimposing toner images of a plurality of colors on the surface of the intermediate transfer material, thereafter transferring the superimposed toner images onto a recording material in a batch, thereby obtaining a final color image is known.

A wet type image forming apparatus using a liquid developing device has advantages which cannot be realized by a dry type image forming apparatus, and in recent years, the value has been reconsidered. The main advantage of the wet type image forming apparatus is that very fine toner of a submicron size can be used, so a high image quality can be realized, and a texture equivalent to printing can be obtained. Particularly, in recent years, in correspondence to speed-up of the image forming apparatus, there has been a trend to use a liquid developer including toner particles dispersed in high concentration in a carrier liquid of high viscosity.

For transfer of a toner image from an image supporting member or an intermediate transfer medium to a recording material in the wet type image forming apparatus, generally, an electrostatic transfer system by electrostatic force is used. Toner particles are charged, so when a voltage with the reverse polarity to the charging polarity of the toner particles is impressed to the transfer roller installed on the rear side of the recording material, the toner particles move to the surface of the recording material by the electrostatic force.

In such an image forming apparatus, to output an image of a high quality regardless of the kind of a recording material used, it is necessary to execute transfer to the recording material stably and highly efficiently.

Japanese Laid-Open Patent Publication H9-304979 discloses the image forming apparatus for controlling, depending on the characteristics of transfer sheets, the toner adhesion amount (the potential of the photoconductor, developing bias voltage), bias voltage to the set roller for stabilizing the toner adhesion condition on the photoconductor, charging current to the photoconductor, transfer current, and fixing temperature. However, the art recorded in this document does not adjust the charging quantity given to toner depending on the property of the recording material, so an image of a sufficiently high quality cannot be outputted.

Further, U.S. Pat. No. 6,115,576 discloses the image forming apparatus for giving a charge of the same polarity as that of toner to a toner image on an intermediate transfer belt. However, the art recorded in this document does not carry out control depending on the property of the recording material, so the transfer efficiency of toner onto the recording material may be deteriorated extremely.

Further, U.S. Pat. No. 6,766,123 discloses the dry type image forming apparatus which has a pre-transfer charging roller, prior to transfer of a toner image, for charging the surface of a recording material with reverse polarity to the charging polarity of the toner and changes a voltage impressed to the charging roller depending on the kind of the recording material. However, the art recorded in this document does not adjust the charging quantity of toner depending on the property of the recording material either, thereby cannot accomplish an object of outputting an image of a sufficiently high quality.

SUMMARY

The present invention was developed with the foregoing in view, and an object of the present invention is to provide an image forming apparatus capable of obtaining an image of a high quality regardless of the kind of a recording material.

Further, another object of the present invention is to provide an image forming apparatus capable of transferring highly efficiently a toner image including an appropriate amount of toner to a recording material depending on the property of the recording material and obtaining an image of a high quality.

In view of forgoing, one embodiment according to one aspect of the present invention is an image forming apparatus, comprising:

an image supporting member;

an image forming mechanism which is adapted to form an electric latent image on the image supporting member;

a developing section which is adapted to develop the electric latent image formed on the image supporting member with a liquid developer including a toner so as to form a toner image;

a transferring section which is adapted to transfer the toner image formed by the developing section onto a recording material;

an input portion which is adapted to input a property of the recording material;

a charge applying section which is adapted to apply to the toner image a charge of opposite polarity to a charge polarity of the toner image between a developing position defined by the developing section and a transferring position defined by the transferring section; and a charge amount control portion which is adapted to control an amount of the charge to be applied by the charge applying section depending on the property of the recording material inputted by the input portion.

According to another aspect of the present invention, another embodiment is a method of forming an image, comprising the steps of:

forming an electric latent image on a image supporting member;

forming a toner image at a developing position defined by a developing section by developing the electric latent image formed on the image supporting member with a liquid developer;

transferring the toner image onto a recording material at a transferring position defined by a transferring section;

judging a property of the recording material;

applying to the toner image, between the developing position and the transferring position, a charge opposite to a charge polarity of the toner image; and controlling the charge to be applied to the toner image depending on the judged property of the recording material.

DETAILED DESCRIPTION OF THE PREFERRED EMBODIMENT

While the preferred embodiments of the present invention have been described using specific terms, such description is for illustrative purpose only, and it is to be understood that changes and variations may be made without departing from the spirit or scope of the appended claims. Hereinafter, embodiments of the present invention will be explained with reference to the accompanying drawings.

First Embodiment (Entire Structure of Image Forming Apparatus)

Figure 1:
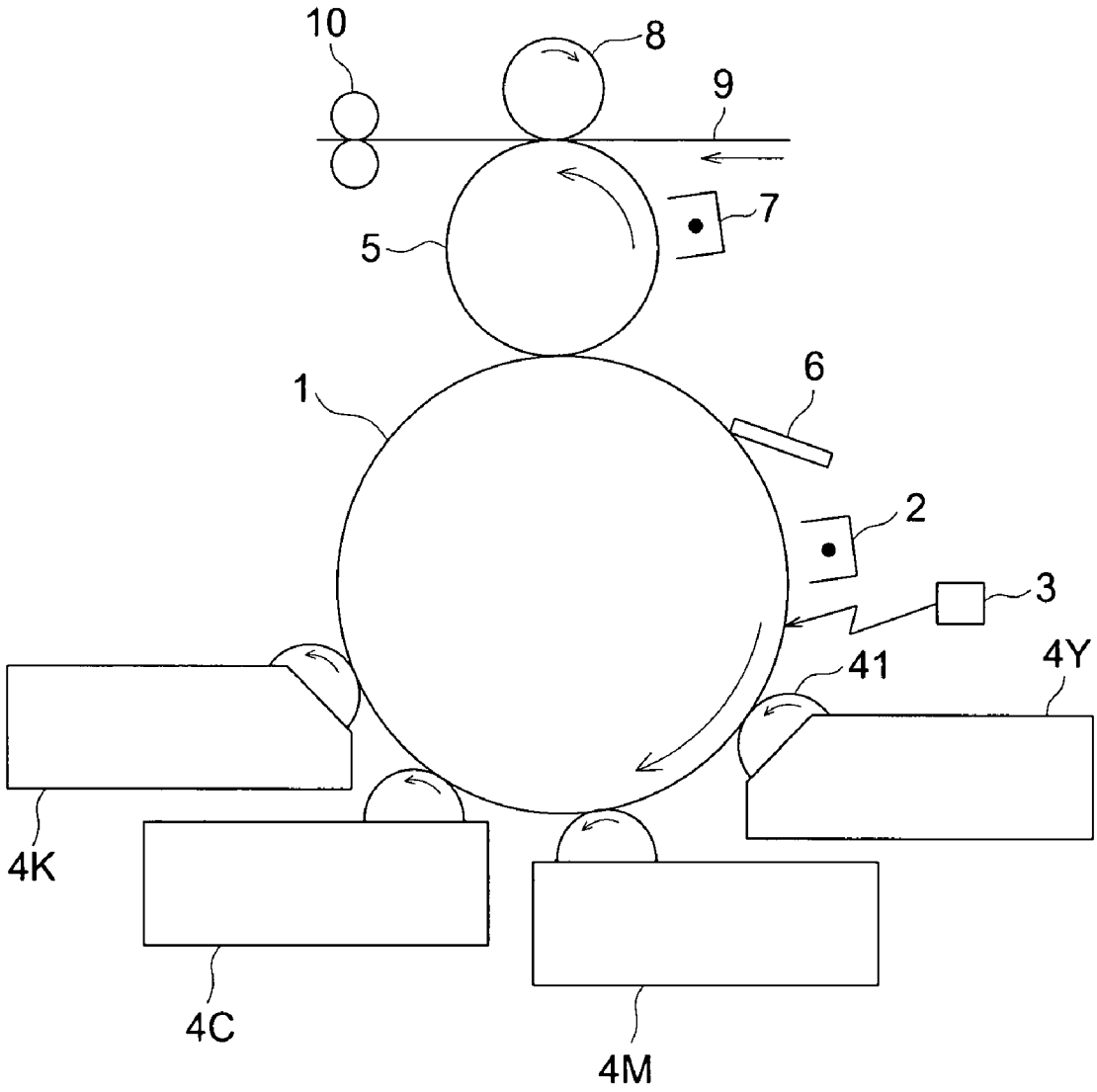
FIG. 1 is a drawing showing a schematic constitution example of the image forming apparatus according to a first embodiment of the present invention.

FIG. 1 is a drawing showing a schematic constitution of the image forming apparatus of a first embodiment of the present invention.

Around a photoconductor 1 as an image supporting member, sequentially in the rotational direction indicated by the arrow, a charger 2, an exposure device 3 as an image forming mechanism, liquid developing devices 4Y, 4M, 4C, and 4K, an intermediate transfer medium 5, and a cleaning device 6 are arranged respectively, and around the intermediate transfer medium 5, a charge applying section 7 and a transfer roller 8 are arranged. The photoconductor 1 and intermediate transfer medium 5 may be formed in a drum shape or a belt shape.

Four sets of the liquid developing devices 4Y, 4M, 4C, and 4K are respectively installed removably from the photoconductor 1 and respectively include a liquid developer storing tank and a developing roller 41 for carrying a liquid developer on the surface thereof and developing an electrostatic latent image on the surface of the photoconductor 1.

The liquid developing device 4Y uses yellow toner, the liquid developing device 4M magenta toner, the liquid developing device 4C cyan toner, and the liquid developing device 4K black toner, and the respective liquid developing devices form toner images of the corresponding colors, the toner images are superimposed on the surface of the intermediate transfer medium 5 and are transferred to a recording material 9 in a batch, thus a full color image can be formed.

(Operation of the Image Forming Apparatus)

The photoconductor 1 rotates in the direction indicated by the arrow. The surface of the photoconductor 1 is charged uniformly to a pre-determined surface potential by the charger 2, thereafter the image information is exposed by the exposure device 3, and an electrostatic latent image is formed on the surface of the photoconductor 1.

Next, the liquid developing device 4Y is directed toward the photoconductor 1, and a liquid developer carried on the surface of the developing roller 41 is permitted to make contact with the photoconductor 1, thus a yellow toner image is formed on the surface of the photoconductor 1.

The liquid developers used in the liquid developing devices 4Y, 4M, 4C, and 4K are ones obtained by dispersing toner particles in an insulating carrier liquid, and furthermore, functionalizing agents such as a charging control agent and a dispersant may be contained.

Although the concentration and viscosity of the liquid developer are not restricted particularly, a liquid developer high in concentration and viscosity in which the solid component such as toner particles is dispersed at a rate from 10 to 50% by mass and the viscosity at 25° C. is within the range from 0.01 Pa·s to 10 Pa·s is suitable particularly. Toner particles are charged with positive polarity beforehand by a toner charging section (a charger 44 shown in FIG. 2).

When the photoconductor 1 rotates more, the toner image on the surface moves to the primary transfer area where the photoconductor 1 and intermediate transfer medium 5 make contact with each other. To the intermediate transfer medium 5, a voltage of negative polarity is impressed by a power supply 21 (FIG. 2), and the toner is moved by the electric field generated by this impressed voltage, thus the toner image on the surface of the photoconductor 1 is primarily transferred to the surface of the intermediate medium 5.

After the primary transfer, the liquid developer remaining on the photoconductor 1 is removed by the cleaning device 6, and the surface of the photoconductor 1 is charged uniformly to a predetermined surface potential by the charger 2.

Then, an electrostatic latent image is formed on the surface of the photoconductor 1 and is developed by the liquid developing device 4M, thus a magenta toner image is formed on the surface of the photoconductor 1. The magenta toner image is primarily transferred thereafter onto the surface of the intermediate transfer medium 5, and on the surface of the intermediate transfer medium 5, the yellow toner image and magenta toner image are superimposed.

Similarly, a cyan toner image developed by the liquid developing device 4C and a black toner image developed by the liquid developing device 4K are also superimposed, and on the surface of the intermediate transfer medium 5, a full-color toner image is formed.

The full-color toner image formed on the surface of the intermediate transfer medium 5, since the intermediate transfer medium 5 rotates in the direction of the arrow, moves to the secondary transfer area where the intermediate transfer medium 5 and recording material 9 make contact with each other.

Figure 2:
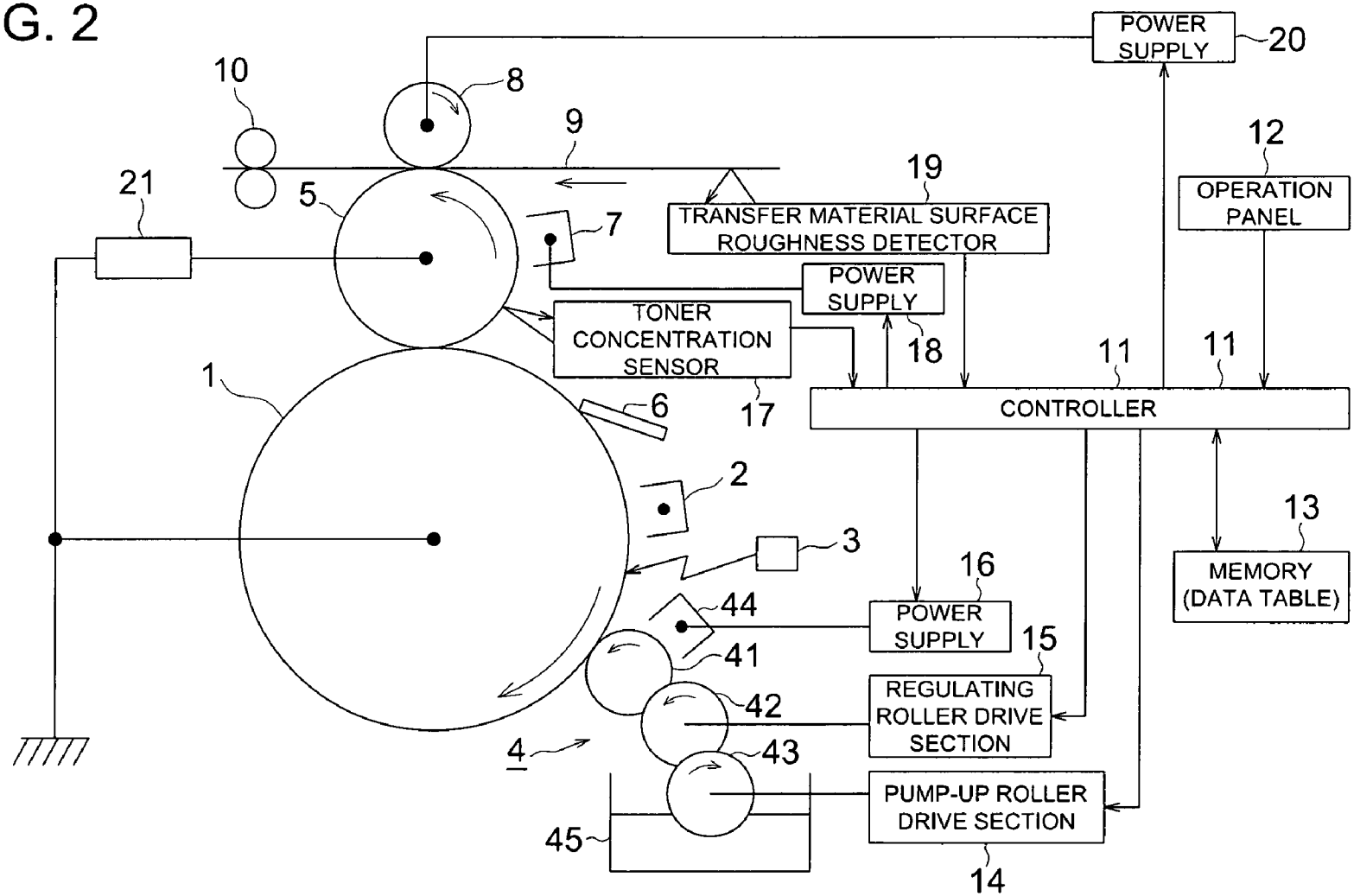
FIG. 2 is a drawing showing a function constitution example according to control for giving a charge to a toner image of the image forming apparatus shown in FIG. 1.

In the secondary transfer area, a linear pressure is applied between the intermediate transfer medium 5 and the recording material 9 by the transfer roller 8 located on the rear of the recording material 9, thus a voltage of negative polarity is impressed to the transfer roller 8 by a power supply 20 (FIG. 2).

By this voltage impression, the surface of the recording material 9 opposite to the intermediate transfer medium 5 is given a negative polarity potential, and by the potential difference between the surface potential of the recording material 9 and the surface potential of the intermediate transfer medium 5, the toner image is attracted to the surface of the recording material 9. The recording material 9 is conveyed in the direction of the arrow and passes through the secondary transfer area, thus the secondary transfer of the toner image onto the recording material 9 is completed.

The recording material 9 onto which the toner image is transferred is fixed by a fixing device 10, and the image output is completed.

(Charging Pre-Transfer Toner)

In this embodiment, prior to transfer to the recording material 9, a charge of reverse polarity to the charging polarity of the toner is given to the toner image transferred to the surface of the intermediate transfer medium 5 by the charge applying section 7. Charging by the charge applying section 7 may be carried out once after all the toner images are superimposed on the surface of the intermediate transfer medium 5 and the full-color image is formed, alternatively, it may be carried out separately several times before all the toner images are superimposed on the surface of the intermediate transfer medium 5.

The image forming apparatus of this embodiment includes a recording material property obtaining section for obtaining the property of the recording material 9, an adjustment section for adjusting the toner amount of a toner image formed by development depending on the property (for example, surface roughness) of the recording material 9, and a controller for controlling the charging quantity by the charge applying section 7 depending on the adjusted toner amount.

FIG. 2 is a drawing showing a whole block diagram of the image forming apparatus similar to the one shown in FIG. 1, and the functions relating to adjustment of the toner amount and control for charging a toner image are added as a block diagram. Further, only one developing device is shown in FIG. 2 for simplification.

In FIG. 2, numeral 11 indicates a controller, which functions as a controller for controlling the charging quantity by the charge applying section 7 depending on the toner amount. Namely, it controls a power supply 18 and controls the charging quantity by the charge applying section 7.

Numeral 12 indicates an operation panel, which is used by an operator for performing an input operation necessary to the control by the controller 11. For example, it functions as an input portion and designated the kind of sheets as a property of the recording material to reflect it on the adjustment of the toner amount.

Numeral 13 indicates a memory for storing a data table or others. For example, data of the charging quantity depending on the toner amount is stored in a table form for reference, or output for adjustment of the toner amount, toner charging quantity, and charging quantity for pre-transfer toner depending on the kind and surface roughness of sheets is stored also as a table.

Numeral 14 indicates a pump-up roller drive section having a function for adjusting the rotation of a pump-up roller 43, thereby adjusting the pump-up amount of a liquid developer from a liquid developer tank 45. Numeral 15 indicates a regulating roller drive section having a function for adjusting the rotation of a regulating roller 42 for receiving feed of a liquid developer from the pump-up roller 43, thereby adjusting the developer feed amount to a developing roller 41. Namely, the pump-up roller drive section 14 and regulating roller drive section 15 function as an adjustment section for adjusting the toner amount. By the adjustment of the liquid developer amount on the developing roller 41, the toner amount of the toner image on the intermediate transfer medium 5 is adjusted.

Numeral 16 indicates a power supply for supplying a voltage to the charger 44 on the developing roller 41 and giving the roller an appropriate charge for the toner to be developed.

Numeral 17 indicates a toner concentration sensor, which detects the toner amount of a toner image on the intermediate transfer medium 5, that is, it senses the toner amount to be transferred to the recording material 9 and sends it to the controller 11 to reflect it on the charging quantity by the charge applying section 7.

Numeral 18 indicates a power supply controlled by the controller 11 for impressing a voltage to the charge applying section 7 so as to give an appropriate charging quantity to the toner image.

Numeral 19 indicates a recording material surface roughness detector, which detects the surface roughness as a property of the recording material and sends it to the controller 11 for adjustment of the toner amount. Namely, it functions as a recording material obtaining section.

By use of the aforementioned constitution, on the basis of the information on the sheet kind from the operation panel 12 or the information on the surface roughness from the recording material surface roughness detector 19, the controller 11 refers to the data table of the memory 13, decides appropriate output to the pump-up roller drive section 14, regulating roller drive section 15, and power supply 16, and controls to drive them. By doing this, depending on the kind of the recording material 9 or the surface roughness, the toner amount on the developing roller 14 is adjusted and charging appropriate to development is carried out. Finally, the toner amount of the toner image on the intermediate transfer medium 5 is sent to the controller 11 by the toner concentration sensor 17.

On the basis of the toner amount on the intermediate transfer medium 5 detected by the toner concentration sensor 17, the controller 11 refers to the data table of the memory 13, decides the charging quantity to be given to the toner image on the intermediate transfer medium 5 by the charge applying section 7, and decides appropriate output for that purpose. At this time, the controller 11 functions as a charge amount control portion. The controller 11 controls the power supply 18 by the decided output, controls the output of the charge applying section 7, thereby gives a charge so as to obtain a toner charging quantity depending on the toner amount on the intermediate transfer medium 5.

The reason of charging the toner image is as indicated below.

(1) Relationship Between the Transfer Efficiency and the Toner Charging Quantity at Time of Transfer In the secondary transfer area for transferring the toner image on the intermediate transfer medium 5 to the recording material 9, as described already, by the potential difference between the surface potential of the recording material 9 and the surface potential of the intermediate transfer medium 5, the toner on the intermediate transfer medium 5 is attracted to the surface of the recording material 9, thus the toner image can be transferred.

On the other hand, toner has positive polarity, so when toner is transferred and adhered to the surface of the recording material 9, the surface potential including the adhered toner on the recording material 9 is shifted toward the positive side compared with the surface potential when toner is not yet adhered and the potential difference between the concerned surface potential and the surface potential of the intermediate transfer medium 5 becomes smaller.

Therefore, when much toner is transferred to the surface of the recording material 9 and the potential difference between the surface potential including the adhered toner on the recording material 9 and the surface potential of the intermediate transfer medium 5 becomes 0, no more toner can be attracted onto the recording material 9. Therefore, the toner amount which can be transferred until the aforementioned potential difference becomes 0 depends on the charging quantity per unit area which can be attracted by the recording material 9 to its surface.

If the charging quantity (hereinafter, called Q/S) per unit area of the toner on the intermediate transfer medium 5 exceeds the limit which can be attracted by the recording material 9, the toner on the intermediate transfer medium 5 cannot be transferred entirely, and the transfer rate is reduced.

Further, when increasing the bias voltage to be impressed to the transfer roller 8, or reducing the electric resistances of the transfer roller 8 and intermediate transfer medium 5, the charging quantity per unit area which can be attracted by the recording material 9 is increased, so the transferable toner amount is increased.

However, when the potential difference between the potential when no toner is adhered to the surface of the recording material 9 and the surface potential of the intermediate transfer medium 5 is increased excessively by such a method, electricity is easily discharged in the neighborhood of the transfer nip. When electricity is discharged, the transfer rate is reduced greatly, so the potential difference between the potential of the surface of the recording material 9 when no toner is adhered and the surface potential of the intermediate transfer medium 5 cannot be increased unnecessarily.

Further, even if the maximum charging quantity Q/S which can be attracted by the recording material 9 is the same, if the charging quantity (hereinafter, called Q/M) per unit mass of the developing toner is reduced, more toner can be transferred. However, also in this case, when Q/M is made smaller, at time of development, toner is easily adhered (fogging) in the image background, so Q/M cannot be made smaller unnecessarily.

As shown by the above description, to transfer a larger amount of toner onto the recording material 9, it is desirable to control the charging quantity Q/S per unit area of toner on the intermediate transfer medium 5 to an appropriate quantity.

(2) Adjustment of the Toner Amount Depending on the Property of the Recording Material As mentioned above, it is desirable to appropriately control the charging quantity Q/S of toner depending on the toner amount to be transferred, and in this embodiment, depending on the property of the recording material 9, the toner amount (hereinafter, called the M/S) on the intermediate transfer medium 5 is adjusted.

To output an image which is transferred to the recording material 9 and has a solid portion of uniform concentration, it is necessary to adhere enough amount of toner to fully cover the uneven surface of the recording material 9. Namely, as the surface roughness of the recording material 9 increases, it is desirable to adhere a larger amount of toner. For example, for paper having a rough surface such as non-coated paper as a recording material 9, the toner adhesion amount is increased compared with coated paper.

On the other hand, to reduce the toner amount used and reduce the load on the printing cost and environment, the toner adhesion amount is preferably as small as possible. Therefore, it is desirable to adjust the toner adhesion amount to a necessary and sufficient amount to cover the surface thereof depending on the surface roughness of the recording material 9. For example, for paper having a low-rough surface such as coated paper as a recording material 9, the toner adhesion amount is preferably decreased compared with paper of high surface roughness such as non-coated paper.

To adjust the toner adhesion amount, firstly, it is necessary to adjust the developing toner amount. For that purpose, for example, the following methods are available.

a. A linear speed ratio 0 to the pump-up roller 43 for feeding a developer to the developing roller 41 of the liquid developing device 4 and the developing roller 41 of the regulating roller 42 is increased and the developer conveying amount on the developing roller 41 is increased; and b. the output of the charger 44 is controlled, and the charging quantity (Q/M) per unit mass of toner on the developing roller 41 is reduced.

In the method of Item b, when Q/M is extremely low, at time of development, toner may be adhered (fogging) in the image background. On the other hand, in the method of Item a, when the output of the toner charging section (the charger 44 shown in FIG. 2) of each of the developing devices 4Y, 4M, 4C, and 4K is adjusted, even when the toner amount is increased, Q/M can be maintained. Therefore, in this embodiment, the method of Item a is employed.

However, even in the method of Item a, when the developing toner amount is increased to accommodate a recording material of high surface roughness, if Q/M is on the similar level to the Q/M when the developing toner amount is small, the charging quantity Q/S per unit area of toner on the intermediate transfer medium 5 is larger than the Q/S when the developing toner amount is small. As a result of an extreme increase in the charging quantity Q/S, if it exceeds the limit of transferable amount to the recording material 9, the toner on the intermediate transfer medium 5 cannot be entirely transferred and there are possibilities that the transfer efficiency is deteriorated.

(3) Charging Depending on the Property of the Recording Material, that is, Toner Amount As mentioned above, although the toner amount of a toner image is adjusted depending on the property (surface roughness) of the recording material, depending on the charging quantity of toner, the transfer efficiency is lowered and the toner of the toner image may not be entirely transferred. Therefore, in this embodiment, when the surface roughness of the recording material 9 is high, the toner amount is adjusted so as to increase the toner adhesion amount, and depending on the toner amount on the intermediate transfer medium 5, the toner of the toner image on the surface of the intermediate transfer medium 5 is charged by the charge applying section 7, and the charging quantity of toner is also adjusted. Namely, the charging quantity by the charge applying section 7 is adjusted depending on the toner amount, and the charging quantity of toner is adjusted, thus also for the recording material 9 having high surface roughness, an image of a high transfer efficiency with a uniform concentration of the solid portion can be obtained.

For example, when using paper having comparatively high surface roughness like non-coated paper as a recording material 9, the toner amount on the intermediate transfer medium 5 is increased and the charging quantity with reverse polarity to that of toner on the intermediate transfer medium 5 by the charge applying section 7 is increased. However, when the charge with reverse polarity to that of toner is given extremely, the charging quantity Q/M per unit mass of toner on the intermediate transfer medium 5 is made small excessively, thus the toner cannot be moved by the electrostatic force, and the transfer efficiency is lowered, so the charging quantity with reverse polarity to that of toner is adjusted so as to maximize the transfer efficiency.

Inversely, when using paper having comparatively low surface roughness like coated paper as a recording material 9, the toner amount on the intermediate transfer medium 5 is reduced, and the charging quantity with reverse polarity to that of toner on the intermediate transfer medium 5 by the charge applying section 7 is reduced, or the charging quantity is made equal to 0, or in certain circumstances, a charge with the same polarity as that of toner is given. Also in the case of the coated paper, when the charge with reverse polarity to that of toner is given extremely, the charging quantity Q/M of toner is made small excessively, thus the transfer efficiency is lowered. In the case of the coated paper, the toner amount is small, so even if the charging quantity with reverse polarity to that of toner is the same, the charging quantity Q/M per unit mass of toner is made smaller, so a high transfer efficiency can be maintained, and the upper limit of the charging quantity with reverse polarity is lowered.

Further, as a charge applying section 7, a typical charge applying section such as a corona charger or a roller charger can be used. Among them, it is preferable to use the corona charger which operates in non-contact and has no possibility to disturb a toner image. Further, when using the roller charger, a constitution of a metallic roller or an elastic roller to which a cleaning member is added may be used.

Further, the charging quantity by the charge applying section 7 may be adjusted by adjusting the output of the charge applying section 7 or by changing the number of charging by the charge applying section 7. Further, both the output and the number may be adjusted.

Furthermore, in this embodiment, the case of using toner particles charged of positive polarity is explained, thus generally, a charge with negative polarity is given by the charge applying section 7, however, an embodiment using toner particles charged with negative polarity beforehand is also available, and in this case, by giving a charge of positive polarity by the charge applying section 7, the same effect can be obtained.

To adjust the toner adhesion amount and charging quantity by the charge applying section 7 depending on the property of the recording material 9, as already mentioned, it is possible for an operator to notify change of the recording material 9 to the image forming apparatus using the operation panel 12, thereby controlling the charging quantity. Alternatively the recording material surface roughness detector 19 may be installed for detecting the surface roughness of the recording material 9 to notify the information on the surface roughness of the recording material 9 to the image forming apparatus, and the charging quantity may be controlled based on the information.

Further, it is possible to install the toner concentration sensor 17 for detecting the toner amount on the intermediate transfer medium 5 and to control the charging quantity on the basis of the detected toner amount. Alternatively when no toner concentration sensor is used, the charging quantity may be adjusted by the charge applying section 7 depending on the property of the recording material 9.

As a recording material surface roughness detector 19, for example, a known detector such as an optical sensor using a difference in the reflected light intensity due to a difference in the surface roughness can be used. In this case, the detector does not necessarily need to obtain a numerical value as surface roughness but may discriminate the magnitude of the surface roughness to be able to decide the appropriate toner adhesion amount to accommodate the roughness. Further, regarding the toner concentration sensor on the intermediate transfer medium 5, a known detector such as an optical sensor can be used.

(Concrete Relationship Between the Property of the Recording Material and the Charging Quantity for Maintaining the Transfer Efficiency)

To explain the relationship between the surface roughness of the recording material 9 and an appropriate charging quantity, an evaluation was conducted by outputting images on four kinds of recording materials using the image forming apparatus shown in FIG. 1. For the intermediate transfer medium 5 and transfer roller 8, a conductive NBR rubber roller is used, and the voltage to be impressed to the transfer roller 8 is set to a value for obtaining a highest transfer efficiency under the respective conditions. Ten-point average roughness Rz of the four kinds of recording materials used is shown in Table 1-1.

TABLE 1-1

| Recording material kind | Surface roughness Rz, JIS (μm) |
|---|---|
| Cast coated paper | 1.7 |
| Gloss coated paper | 2.3 |
| Matte coated paper | 4.8 |
| Non-coated paper | 12 |

Rz JIS: Ten-point average roughness (JIS B 0633: 2001)

As mentioned above, to obtain an image having a uniform solid concentration, it is necessary to fully cover the surface of the recording material 9 with toner, and for that purpose, it is desirable to change the toner adhesion amount depending on the surface roughness of the recording material 9. Further, from the viewpoint of reducing the toner consumption amount, thereby reducing the load on the printing cost and environment, it is preferable to reduce the toner adhesion amount as much as possible and from the aforementioned viewpoint, for each recording material, the toner adhesion amount is adjusted to a necessary and sufficient amount.

Concretely, the toner amount of the solid portion of each color on the intermediate transfer medium 5 is defined as 1.5 $g/m^2$ for the cast coated paper and gloss coated paper, 2.0 $g/m^2$ for the matte coated paper, and 2.5 $g/m^2$ for the non-coated paper.

The toner amount is adjusted by adjusting the linear speed ratio of the feed roller (the regulating roller 42) to the developing roller 41, and the output of the corona charger 44 for charging toner in each of the developing devices 4Y, 4M, 4C, and 4K is adjusted, thus even if the toner amount is changed, the charging quantity Q/M per unit mass of toner on the developing roller 41 is kept almost constant.

The liquid developer used is a one in which toner composed of a pigment dispersed in a resin is dispersed in a non-volatile insulating carrier, and to which a small amount of dispersant is added. The rate of toner of the liquid developer is 25% by mass and the viscosity of the liquid developer at 25° C. is high such as 0.1 Pa·s. The average particle diameter of toner is 2.5 μm.

The transfer efficiency is evaluated under the following condition. A solid image superimposed in two colors of magenta and cyan is outputted and assuming the mass of toner formed on the intermediate transfer medium 5 before transfer to the recording material 9 as A and the mass of toner remaining on the intermediate transfer medium 5 after transfer to the recording material 9 as B, the transfer efficiency is calculated by the following formula.

$$\text{Transfer efficiency [\%]}=((A-B)/A)\times 100$$

The corona charger is used for the charge applying section 7, and the current flowing into the intermediate transfer medium 5 is adjusted, thereby the charging quantity is changed. The flowing-in current aforementioned is the remainder obtained by removing the current flowing into the casing of the corona charger from the current flowing out from the power supply.

The flowing-in current aforementioned and charging quantity are proportional to each other, and when the flowing-in current is −100 μA, the charging quantity per unit area to the intermediate transfer medium 5 on the surface on which a toner image is formed is −833 μC/m$^2$.

Charging is carried out once after a magenta and a cyan toner image are superimposed on the surface of the intermediate transfer medium 5. Further, the linear pressure at time of transfer is defined as 30 N/cm. The contact length in the direction of the roller shaft is all 30 cm.

The evaluation results of the transfer efficiency are shown in Table 1-2.

TABLE 1-2

| Transfer efficiency (%) | | | | | |
|---|---|---|---|---|---|
| Flowing-in current (μA) | 0 | −25 | −50 | −75 | −100 |
| Charging quantity (μC/m$^2$) | 0 | −208 | −417 | −625 | −833 |
| Cast coated paper | 100 | 100 | 100 | 95 | 90 |
| Gloss coated paper | 100 | 100 | 100 | 95 | 90 |
| Matte coated paper | 95 | 100 | 100 | 100 | 95 |
| Non-coated paper | 80 | 90 | 95 | 100 | 95 |

In the case of the cast coated paper and gloss coated paper having low surface roughness, even if the charging quantity is 0, the transfer efficiency is 100%, while in the case of the matte coated paper and non-coated paper having high surface roughness, the transfer efficiency are lowered.

The reason may be considered that the output of the toner charging section in each of the developing devices 4Y, 4M, 4C, and 4K is adjusted for the paper having high surface roughness so as to increase the toner adhesion amount, while so as to make Q/M almost equal, so the charging quantity Q/S per unit area of toner on the intermediate transfer medium 5 is increased extremely.

However, when increasing the charging quantity for the matte coated paper and non-coated paper, the transfer efficiency reaches 100%. The reason may be considered that the charge with reverse polarity to that of toner is given, thus Q/S is reduced below the limit of the attracted quantity to the recording material 9.

However, as the charging quantity is more increased, the transfer efficiency is lowered to the contrary. The reason may be considered that the charging quantity Q/M per unit mass of toner is reduced extremely, thus the electrostatic force for electrostatic transfer does not function sufficiently.

In the matte coated paper and non-coated paper, when the charging quantity is −625 μC/m$^2$, the transfer efficiency is 100%, while in the cast coated paper and gloss coated paper, under the same condition, the transfer efficiency is 95%. The reason is that in the cast coated paper and gloss coated paper, the toner adhesion amount is small, so even if the charging quantity is the same, Q/M is lowered more.

As mentioned above, by adjusting the toner amount on the intermediate transfer medium 5 depending on the kind of the recording material 9 while the charging quantity for the toner image on the intermediate transfer medium 5 is adjusted, a high-quality image accommodating the kind of the recording material 9 can be outputted because the transfer efficiency can be maximized while ensuring the uniformity of the solid portion concentration.

(Modification of this Embodiment)

Figure 3:
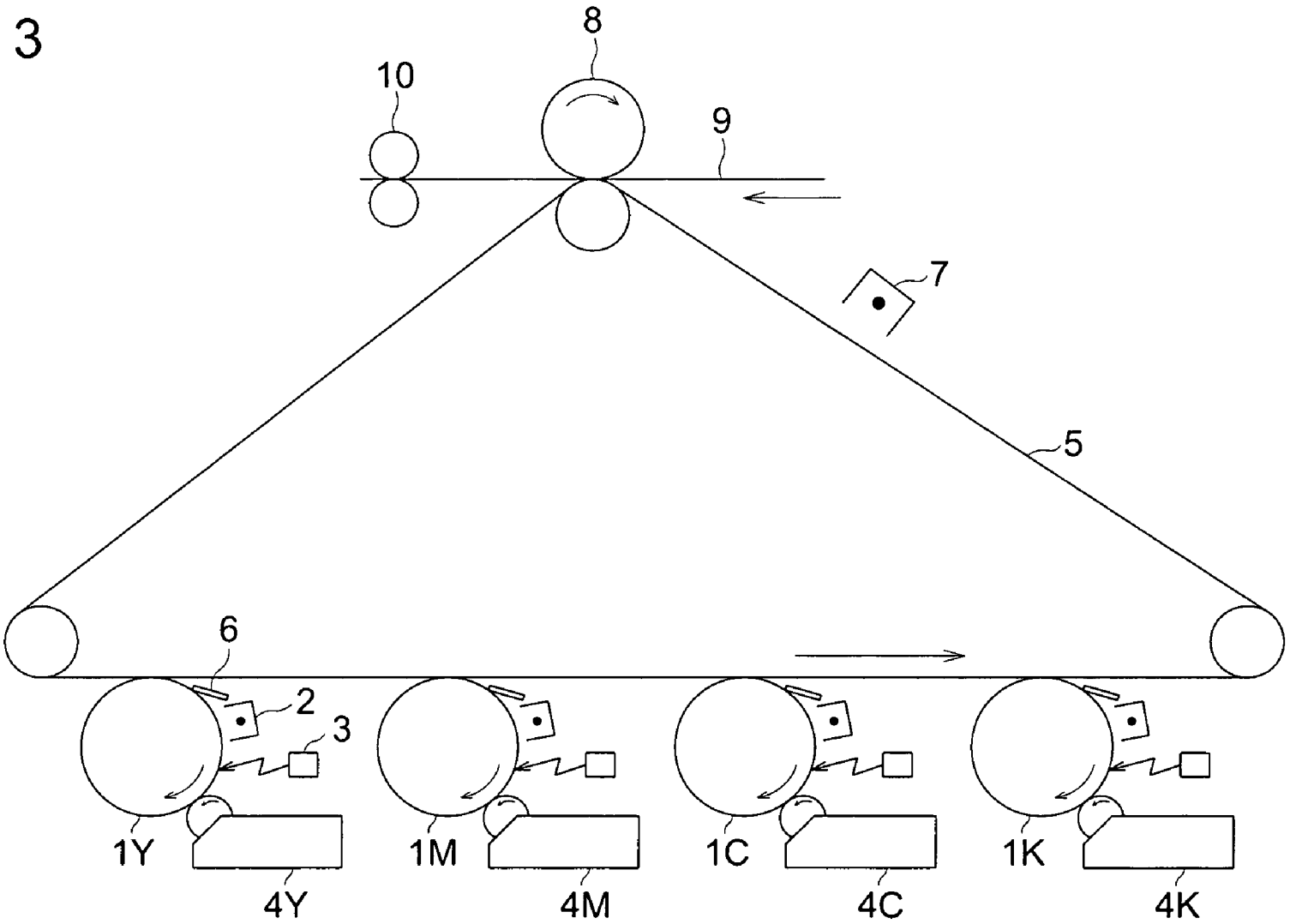
FIG. 3 is a drawing showing a schematic constitution of a modification as another embodiment of the image forming apparatus according to the first embodiment of the present invention.

Further, in this embodiment, as shown in FIG. 1, an example of the image forming apparatus having a constitution that around one photoconductor 1, four sets of liquid developing devices 4Y, 4M, 4C, and 4K are arranged is explained. However, the same effect can be obtained, as shown in FIG. 3, also in the case of an image forming apparatus having a constitution that four sets of photoconductors 1Y, 1M, 1C, and 1K are arranged around the intermediate transfer medium 5 and each photoconductor has one liquid developing device.

Figure 4:
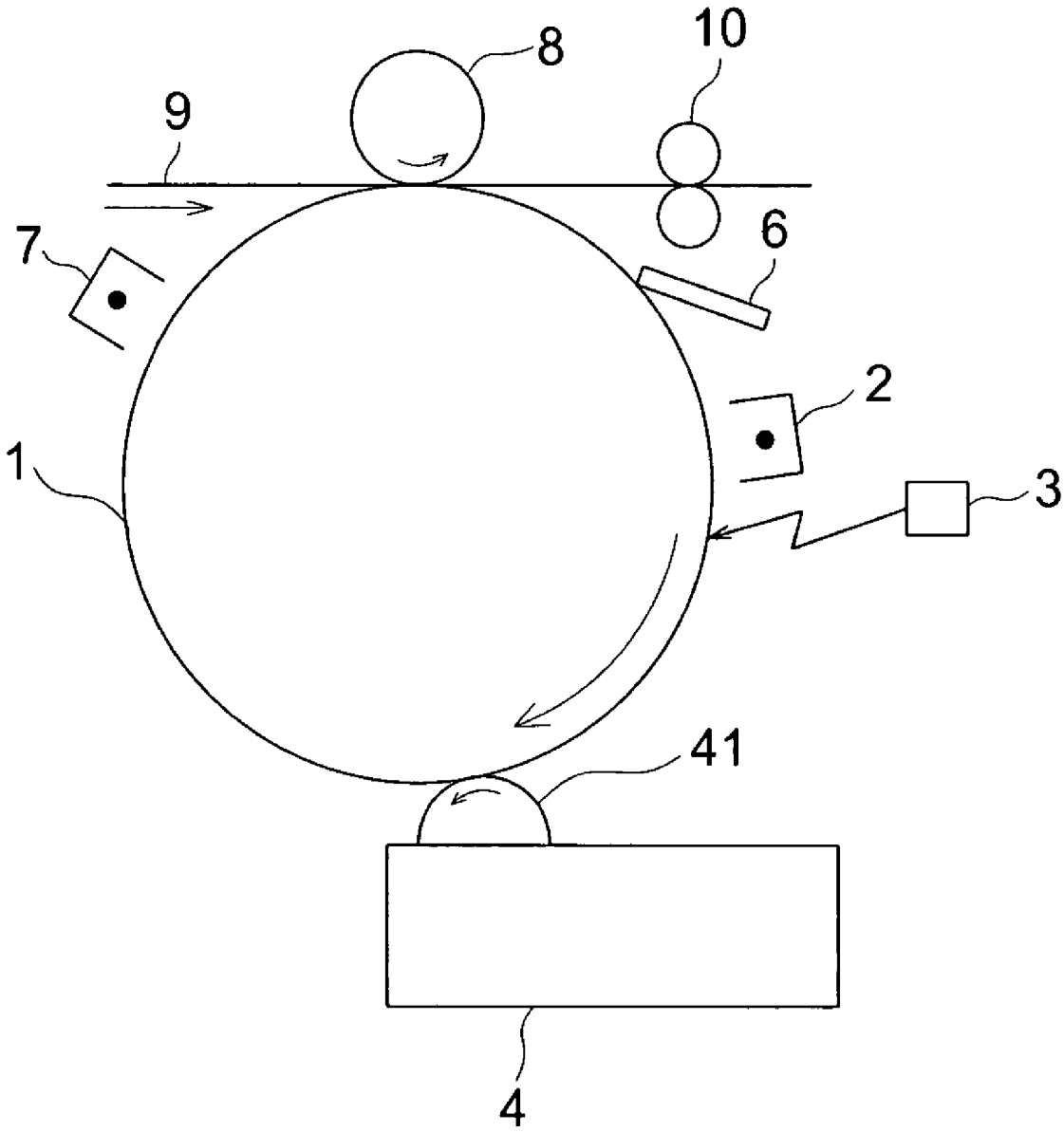
FIG. 4 is a drawing showing a schematic constitution example of another embodiment of the image forming apparatus according to the first embodiment of the present invention.

Further, FIG. 4 is a drawing showing the schematic constitution of the image forming apparatus which is a modification of this embodiment. Around the photoconductor 1 as an image supporting member, sequentially in the rotational direction indicated by the arrow, the charger 2, exposure device 3, liquid developing device 4, charge applying section 7, transfer roller 8, and cleaning device 6 are arranged respectively. Unlike the image forming apparatus shown in FIG. 1, the concerned image forming apparatus is a monochromatic image forming apparatus having only one set of liquid developing device 4 and is not equipped with an intermediate transfer medium. Except it, the constitution is basically the same as that of the image forming apparatus shown in FIG. 1.

The operation of the image forming apparatus shown in FIG. 4 is basically the same as that of the image forming apparatus shown in FIG. 1 except that no intermediate transfer medium is used, and a toner image on the surface of the photoconductor 1 is transferred directly to the recording material 9. Namely, an electrostatic latent image formed on the surface of the photoconductor 1 is developed by the liquid developing device 4, and a toner image is formed on the surface of the photoconductor 1.

The toner image is given a charge of an amount depending on the toner amount on the photoconductor by the charge applying section 7, then is impressed a bias voltage while being applied with a linear pressure by the transfer roller 8, and is transferred to the recording material 9. Finally, the recording material 9 to which the toner image is transferred is fixed by the fixing device 10, thus image output is completed.

Even in the apparatus for transferring the toner image on the surface of the photoconductor 1 directly to the recording material 9 like this, the relationship between the charging quantity per unit area of toner before transfer and the transfer efficiency are the same as those in the apparatus having the intermediate transfer medium. Namely, by adjusting the charging quantity for the toner image on the photoconductor while adjusting the toner amount on the photoconductor depending on the kind of the recording material, an image of a high image quality accommodating the kind of the recording material can be outputted because the transfer efficiency can be maximized while ensuring the uniformity of the solid portion.

Hereinafter, the experimental examples of the first embodiment will be given.

Experimental Example 1-1

The image forming apparatus shown in FIG. 1 is used, and the toner amount on the intermediate transfer medium is adjusted for each kind of the recording material, and an optimum charging quantity is selected on the basis of the results shown in Table 2 depending on the toner amount, and the transfer efficiency is examined by outputting images.

The toner adhesion amount, in the case of the solid portion of each color on the intermediate transfer medium, is set as 1.5 g/m$^2$ for the cast coated paper and gloss coated paper, 2.0 g/m$^2$ for the matte coated paper, and 2.5 g/m$^2$ for the non-coated paper.

The toner amount is adjusted by adjusting the rotational frequency ratio of the feed roller to the developing roller, and the output of the toner charging section in the developing device is adjusted so even if the toner amount is changed, the average charging quantity Q/M of toner on the developing roller is kept almost constant. The linear pressure at time of transfer is set to 30 N/cm. The other conditions are the same as those for the experiment shown in Table 2.

The results are shown in Table 1-3. A high transfer efficiency can be realized while keeping the solid concentration uniform for every recording material, and regardless of the kind of the recording material, high-quality images can be obtained.

TABLE 1-3

| | | *1 | Charging quantity (μC/m²) | Transfer efficiency (%) | Solid concentration uniformity |
|---|---|---|---|---|---|
| Experimental Example 1-1 | Cast coated paper | 1.5 | 0 | 100 | Satisfactory |
| | Gloss coated paper | 1.5 | 0 | 100 | Satisfactory |
| | Matte coated paper | 2.0 | −417 | 100 | Satisfactory |
| | Non-coated paper | 2.5 | −625 | 100 | Satisfactory |

*1: Tonner adhesion amount of solid portion on intermediate transfer medium (g/m²)

Experimental Examples 1-2 to 1-6

Under the same conditions as those of Experimental Example 1, instead of selecting an optimum charging quantity depending on the toner amount on the intermediate transfer medium, the charging quantity is fixed to five values such as 0 (Experimental Example 1-2), −208 μC/m² (Experimental Example 1-3), −417° C./m² (Experimental Example 1-4), −625 μC/m² (Experimental Example 1-5), and −833 μC/m² (Experimental Example 1-6), and by outputting images onto four kinds of recording materials, the transfer efficiencies at those times are examined.

The results are shown in Table 1-4. In every experimental example, depending on the kind of the recording material, compared with Experimental Example 1-1, the transfer efficiency may be deteriorated.

TABLE 1-4

| | | *1 | Charging quantity (μC/m²) | Transfer efficiency (%) |
|---|---|---|---|---|
| Experimental Example 1-2 | Cast coated paper | 1.5 | 0 | 100 |
| | Gloss coated paper | 1.5 | 0 | 100 |
| | Matte coated paper | 2.0 | 0 | 95 |
| | Non-coated paper | 2.5 | 0 | 80 |
| Experimental Example 1-3 | Cast coated paper | 1.5 | −208 | 100 |
| | Gloss coated paper | 1.5 | −208 | 100 |
| | Matte coated paper | 2.0 | −208 | 100 |
| | Non-coated paper | 2.5 | −208 | 90 |
| Experimental Example 1-4 | Cast coated paper | 1.5 | −417 | 100 |
| | Gloss coated paper | 1.5 | −417 | 100 |
| | Matte coated paper | 2.0 | −417 | 100 |
| | Non-coated paper | 2.5 | −417 | 95 |
| Experimental Example 1-5 | Cast coated paper | 1.5 | −625 | 95 |
| | Gloss coated paper | 1.5 | −625 | 95 |
| | Matte coated paper | 2.0 | −625 | 100 |
| | Non-coated paper | 2.5 | −625 | 100 |
| Experimental Example 1-6 | Cast coated paper | 1.5 | −833 | 90 |
| | Gloss coated paper | 1.5 | −833 | 90 |
| | Matte coated paper | 2.0 | −833 | 95 |
| | Non-coated paper | 2.5 | −833 | 95 |

*1: Tonner adhesion amount of solid portion on intermediate transfer medium (g/m²)

Experimental Example 1-7

Under the same conditions as those of Experimental Example 1-1, instead of adjusting the toner adhesion amount for each kind of the recording material, for every recording material, the toner adhesion amount in the case of the solid portion of each color on the intermediate transfer medium is set to 1.5 g/m². The charging quantity is fixed to 0 and by outputting images onto four kinds of recording materials, the transfer efficiencies at those times are examined.

The results are shown in Table 1-5. In all the four kinds of recording materials, high transfer efficiencies can be realized, though in the matte coated paper and non-coated paper, the solid concentration uniformity is inferior to that of Experimental Example 1-1.

TABLE 1-5

| | | *1 | Charging quantity (μC/m²) | Transfer efficiency (%) | Solid concentration uniformity |
|---|---|---|---|---|---|
| Experimental Example 1-7 | Cast coated paper | 1.5 | 0 | 100 | Satisfactory |
| | Gloss coated paper | 1.5 | 0 | 100 | Satisfactory |
| | Matte coated paper | 1.5 | 0 | 100 | Slightly unsatisfactory |
| | Non-coated paper | 1.5 | 0 | 100 | Unsatisfactory |

*1: Tonner adhesion amount of solid portion on intermediate transfer medium (g/m²)

Experimental Example 1-8

The same image forming apparatus as Experimental Example 1-1 is used. As a charge applying section 7, the same corona charger as Experimental Example 1-1 is used, however, the charging quantity for one time is fixed to −208 μC/m², and the charging number is changed, thereby the charging quantity is adjusted.

From the four charging numbers such as zero times, one time (charging quantity −208 μC/m²), two times (charging quantity −417 μC/m²), and three times (charging quantity −625 μC/m$^2$), for kinds of recording material, an optimum charging number depending on the toner amount on the intermediate transfer medium is selected.

The toner adhesion amount in the case of the solid portion of each color on the intermediate transfer medium, is set to 1.5 g/m$^2$ for the cast coated paper and gloss coated paper, 2.0 g/m$^2$ for the matte coated paper, and 2.5 g/m$^2$ for the non-coated paper.

The transfer efficiency is evaluated using solid images of the two superimposed colors of magenta and cyan. Toner images are transferred primarily to the intermediate transfer medium in the order of magenta and cyan, and the toner images of two colors are superimposed and then are secondarily transferred to the recording material to form an image. The linear pressure at time of transfer is set to 30 N/cm. The contact length in the direction of the roller shaft is all 30 cm.

The results are shown in Table 1-6. For every recording material, a high transfer efficiency can be realized while ensuring a uniform solid concentration, and regardless of the kind of the recording material, high-quality images can be obtained. Further, the charging timing is as indicated below.

One time of charging number: Once after primary transfer of a cyan toner image

Two times of charging number: Twice after primary transfer of a cyan toner image Three times of charging number: Once after primary transfer of a magenta toner image and twice after primary transfer of a cyan toner image

TABLE 1-6

| | | *1 | Charging number | Charging quantity (μC/m$^2$) | Transfer efficiency (%) | Solid concentration uniformity |
|---|---|---|---|---|---|---|
| Experimental Example 1-8 | Cast coated paper | 1.5 | 0 time | 0 | 100 | Satisfactory |
| | Gloss coated paper | 1.5 | 0 time | 0 | 100 | Satisfactory |
| | Matte coated paper | 2.0 | 2 times | −417 | 100 | Satisfactory |
| | Non-coated paper | 2.5 | 3 times | −625 | 100 | Satisfactory |

*1: Tonner adhesion amount of solid portion on intermediate transfer medium (g/m$^2$)

Experimental Examples 1-9 to 1-12

Under the same conditions as Experimental Example 1-8, instead of selecting an optimum charging number depending on the toner amount on the intermediate transfer medium, the charging number is fixed to the four kinds such as zero times, one time (charging quantity −208 μC/m$^2$), two times (charging quantity −417 μC/m$^2$), and three times (charging quantity −625 μC/m$^2$) and by outputting images onto four kinds of recording materials, the transfer efficiencies at those times are examined.

The results are shown in Table 1-7. In every experimental example, some of the transfer efficiencies are deteriorated, depending on the kind of the recording material, compared with Experimental Example 1-8.

TABLE 1-7

| | | *1 | Charging number | Charging quantity (μC/m$^2$) | Transfer efficiency (%) |
|---|---|---|---|---|---|
| Experimental Example 1-9 | Cast coated paper | 1.5 | 0 time | 0 | 100 |

TABLE 1-7-continued

| | | *1 | Charging number | Charging quantity (μC/m$^2$) | Transfer efficiency (%) |
|---|---|---|---|---|---|
| | Gloss coated paper | 1.5 | 0 time | 0 | 100 |
| | Matte coated paper | 2.0 | 0 time | 0 | 95 |
| | Non-coated paper | 2.5 | 0 time | 0 | 80 |
| Experimental Example 1-10 | Cast coated paper | 1.5 | 1 time | −208 | 100 |
| | Gloss coated paper | 1.5 | 1 time | −208 | 100 |
| | Matte coated paper | 2.0 | 1 time | −208 | 100 |
| | Non-coated paper | 2.5 | 1 time | −208 | 90 |
| Experimental Example 1-11 | Cast coated paper | 1.5 | 2 times | −417 | 100 |
| | Gloss coated paper | 1.5 | 2 times | −417 | 100 |
| | Matte coated paper | 2.0 | 2 times | −417 | 100 |
| | Non-coated paper | 2.5 | 2 times | −417 | 95 |
| Experimental Example 1-12 | Cast coated paper | 1.5 | 3 times | −625 | 95 |
| | Gloss coated paper | 1.5 | 3 times | −625 | 95 |
| | Matte coated paper | 2.0 | 3 times | −625 | 100 |

TABLE 1-7-continued

| | | *1 | Charging number | Charging quantity (μC/m$^2$) | Transfer efficiency (%) |
|---|---|---|---|---|---|
| | paper | | | | |
| | Non-coated paper | 2.5 | 3 times | −625 | 100 |

*1: Tonner adhesion amount of solid portion on intermediate transfer medium (g/m$^2$)

Experimental Example 1-13

Although under the same conditions as those of Experimental Example 1-8, a metallic corona charger made of aluminum is used as a charging section 7. Similarly to Experimental Example 1-8, the charging quantity for one time is fixed to −208 μC/m$^2$, and the charging number is changed, thus the charging quantity is adjusted.

From the four charging frequencies such as zero times, one time (charging quantity −208 μC/m$^2$), two times (charging quantity −417° C./m$^2$), and three times (charging quantity −625 μC/m$^2$), for the four kinds of recording materials, an optimum charging number depending on the toner amount on the intermediate transfer medium is selected.

The results are shown in Table 1-8. For every recording material, a high transfer efficiency can be realized while ensuring a uniform solid concentration, and regardless of the kind of the recording material, high-quality images can be obtained.

TABLE 1-8

| | | *1 | Charging number | Charging quantity (μC/m²) | Transfer efficiency (%) | Solid concentration uniformity |
|---|---|---|---|---|---|---|
| Experimental Example 1-13 | Cast coated paper | 1.5 | 0 time | 0 | 100 | Satisfactory |
| | Gloss coated paper | 1.5 | 0 time | 0 | 100 | Satisfactory |
| | Matte coated paper | 2.0 | 2 times | −417 | 100 | Satisfactory |
| | Non-coated paper | 2.5 | 3 times | −625 | 100 | Satisfactory |

*1: Tonner adhesion amount of solid portion on intermediate transfer medium (g/m²)

Experimental Examples 1-14 to 1-17

Under the same conditions as those of Experimental Example 1-13, instead of selecting an optimum charging number depending on the toner amount on the intermediate transfer medium for each kind of the recording material, the charging number is fixed to the four kinds such as zero times, one time (charging quantity −208 μC/m²), two times (charging quantity −417 μC/m²), and three times (charging quantity −625 μC/m²) and by outputting images onto four kinds of recording materials, the transfer efficiencies at those times are examined.

The results are shown in Table 1-9. In every experimental example, some of the transfer efficiencies are deteriorated, depending on the kind of the recording material, compared with Experimental Example 1-13.

TABLE 1-9

| | | *1 | Charging number | Charging quantity (μC/m²) | Transfer efficiency (%) |
|---|---|---|---|---|---|
| Experimental Example 1-14 | Cast coated paper | 1.5 | 0 time | 0 | 100 |
| | Gloss coated paper | 1.5 | 0 time | 0 | 100 |
| | Matte coated paper | 2.0 | 0 time | 0 | 95 |
| | Non-coated paper | 2.5 | 0 time | 0 | 80 |
| Experimental Example 1-15 | Cast coated paper | 1.5 | 1 time | −208 | 100 |
| | Gloss coated paper | 1.5 | 1 time | −208 | 100 |
| | Matte coated paper | 2.0 | 1 time | −208 | 100 |
| | Non-coated paper | 2.5 | 1 time | −208 | 90 |
| Experimental Example 1-16 | Cast coated paper | 1.5 | 2 times | −417 | 100 |
| | Gloss coated paper | 1.5 | 2 times | −417 | 100 |
| | Matte coated paper | 2.0 | 2 times | −417 | 100 |
| | Non-coated paper | 2.5 | 2 times | −417 | 95 |
| Experimental Example 1-17 | Cast coated paper | 1.5 | 3 times | −625 | 95 |
| | Gloss coated paper | 1.5 | 3 times | −625 | 95 |
| | Matte coated paper | 2.0 | 3 times | −625 | 100 |
| | Non-coated paper | 2.5 | 3 times | −625 | 100 |

*1: Tonner adhesion amount of solid portion on intermediate transfer medium (g/m²)

Second Embodiment

Hereinafter, the second embodiment of the present invention will be explained.

Figure 5:
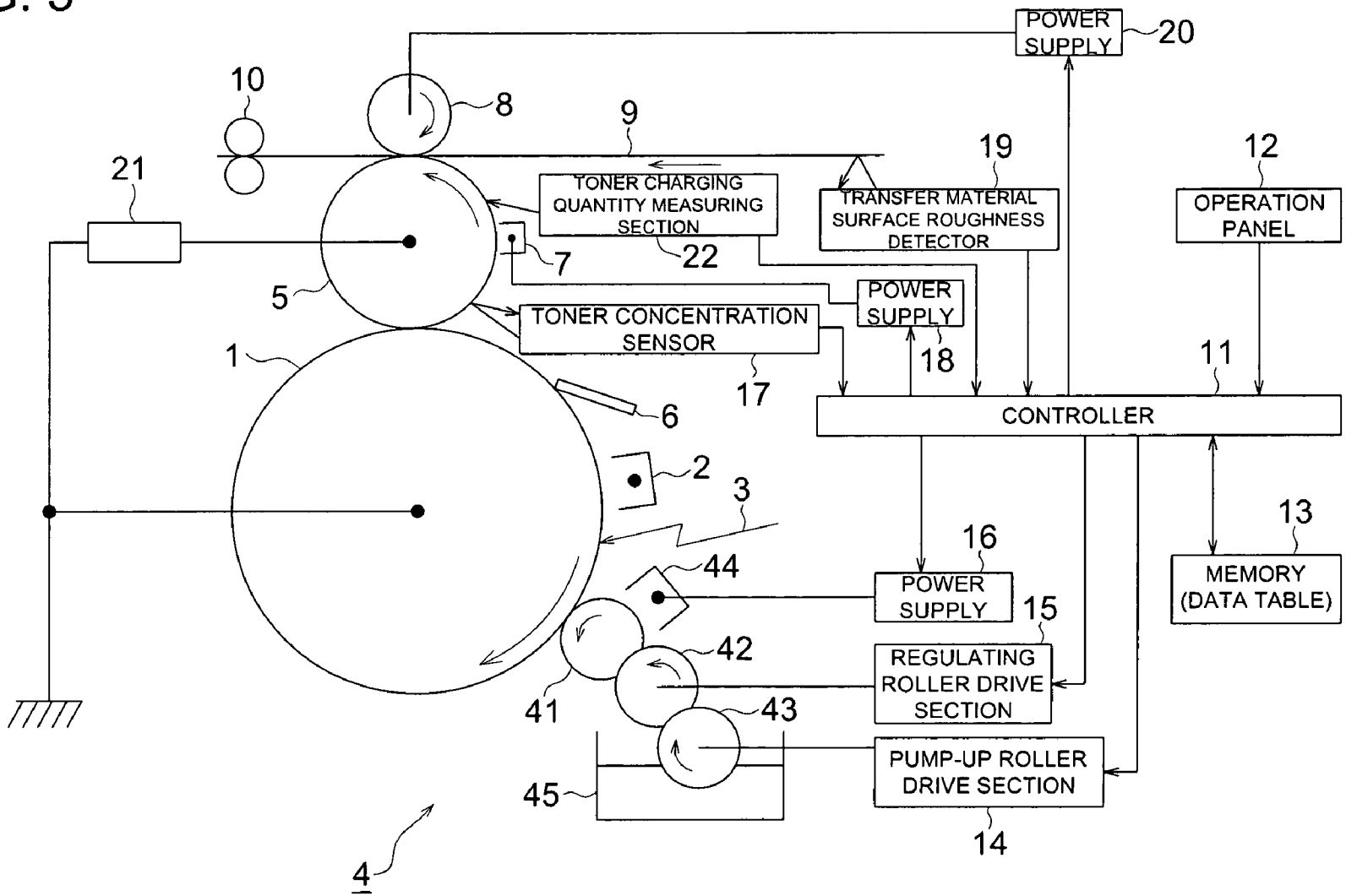
FIG. 5 is a drawing showing a schematic constitution example of the image forming apparatus according to a second embodiment of the present invention.

The image forming apparatus of the second embodiment is different from the aforementioned constitution of the first embodiment only in respect of addition of a function for adjusting the transfer current. FIG. 5 is a drawing showing the image forming apparatus of this embodiment. This embodiment is different from the constitution explained in FIG. 2 in the respect that a toner charging quantity measuring section 22 is installed on the downstream side of the charge applying section 7. Further, the same components as those explained in FIG. 2 will be excluded from the explanation.

Also in the image forming apparatus of this embodiment, a full-color toner image formed on the surface of the intermediate transfer medium 5 is transferred onto the recording material 9 by impressing a bias voltage to the transfer roller 8 in the secondary transfer area where the intermediate transfer medium 5 and recording material 9 make contact with each other.

In impression of the bias voltage to the transfer roller 8, there are a so-called constant-voltage control for controlling the impressed voltage constant and a so-called constant-current control for controlling the impressed current constant available, and in this embodiment, the constant-current control is used. The reason is that even if the charging quantity held by a toner image before transfer is changed, a transfer rate of almost 100% can be realized by setting a current corresponding to it.

Also in the image forming apparatus of this embodiment, the toner amount to be adhered onto the recording material 9 is adjusted depending on the property of the recording material 9 similarly to the first embodiment aforementioned. Therefore, when using sheets of paper having high surface roughness, the developer feed amount on the developing roller 41 is increased. When the developer feed amount on the developing roller 41 is increased, the toner charging quantity (the charging quantity Q/M per unit mass of toner) get to be reduced. When Q/M is extremely small, at time of development, toner may be adhered (fogging) in the image background. To prevent it, the output of the toner charging section 44 in the developing device 4 is adjusted, thus even if the toner amount is increased, Q/M can be maintained.

However, when the developing toner amount is increased in order to accommodate a recording material having high surface roughness, an operation to make Q/M on the same level as that when the toner amount is small causes the charging quantity Q/S per unit area held by a toner image before transfer is made to be larger than that when the toner amount is small. On the other hand, at time of transfer, by impressing a bias voltage to the transfer roller 8, a charge of reverse polarity to that of the toner is fed to the surface of the recording material 9, and the reverse-polarity charge is tied up with the toner, thus the toner is held on the recording material. When the charging quantity Q/S per unit area held by the toner image before transfer is increased and exceeds the charging quantity of reverse polarity fed to the surface of the recording material 9, the transfer efficiency is deteriorated.

To the contrary, when the charging quantity Q/S per unit area held by the toner image before transfer is not so large, if the feed current to the transfer roller 8 is too large, the reverse polarity charge more than needed is fed to the surface of the recording material 9, so electricity is discharged before transfer and the transfer becomes unstable.

For the reason aforementioned, depending on the charging quantity Q/S per unit area held by the toner image before transfer, it is desirable to control the current to be supplied to the transfer roller 8 so as to permit a current necessary and sufficient to transfer 100% of toner to flow. Namely, in this embodiment, the charging quantity Q/S per unit area held by the toner image before transfer is adjusted by the charge applying section 7, though when the adjustment is not perfect, satisfactory transfer is realized by adjusting the transfer current. Concretely, the charging quantity Q/S per unit area held by the toner image before transfer is measured by the toner charging quantity measuring section 22 and the transfer current is controlled depending on the charging quantity.

In FIG. 5, the controller 11 functions as a toner amount adjusting section for adjusting the toner amount depending on the property of the recording material 9, a toner charging quantity controlling section for controlling the toner charging quantity by the toner charging section 44, a charge amount control portion for controlling the charging quantity by the charge applying section 7 depending on the toner amount, and a transfer current control section for controlling the transfer current flowing through the transfer roller 8 depending on the charging quantity of toner before transfer.

The memory 13 stores the relationship between the toner amount and charging quantity depending on the kind and surface roughness of sheets and an appropriate transfer current as a data table. Further, the memory 13 may store outputs for toner amount adjustment depending on the kind and surface roughness of sheets, toner charging quantity adjustment, charge applying quantity adjustment to toner before transfer, and transfer current adjustment as a table.

The toner charging quantity measuring section 22 measures the toner charging quantity of the toner image on the intermediate transfer medium 5, that is, the charging quantity of the toner immediately before it is transferred to the recording material 9, and the toner charging quantity measuring section 22 sends it to the controller 11 to reflect it to the transfer current in the transfer roller 8.

The power supply 20 for transfer is controlled by the controller 11 and impresses a voltage so as to supply an appropriate transfer current to the transfer roller 8.

On the basis of the information on the sheet kind from the operation panel 12 or the surface roughness information from the recording material surface roughness detector 19, the controller 11 refers to the data table of the memory 13 and decides appropriate output to the pump-up roller drive section 14, regulating roller drive section 15, and power supply 16. By controlling those values, the toner amount on the developing roller 41 and toner charging quantity are adjusted to appropriate values depending on the kind or surface roughness of the recording material 9.

When changing the toner amount on the developing roller 41 and output of the toner charging section 44, the toner amount on the intermediate transfer medium 5 and the charging quantity held by the toner image are changed. The charging quantity on the toner image by the charge applying section 7 is adjusted depending on the toner amount, however, when the adjustment is not perfect, it is desirable to adjust the transfer current depending on the charging quantity of the toner image. Therefore, the charging quantity per unit area held by the toner image on the intermediate transfer medium 5 is detected using a surface electrometer (the toner charging quantity measuring section 17), and on the basis of it, the transfer current is changed.

On the other hand, it is possible to control the transfer current without using the toner charging quantity measuring section such as the surface electrometer. The reason is that when the toner amount on the developing roller 41, the output of the toner charging section 44, and the output of the charge applying section 7 are decided, the charging quantity per unit area held by the toner image on the intermediate transfer medium 5 is decided roughly. In this case, for each condition of the toner amount (the toner amount is decided by the drive rotation frequency of each roller), output of the toner charging section 44, and output of the charge applying section 7, it is possible to examine beforehand the supply current conditions for the transfer roller 8 so as to realize 100% transfer, store the relationships in the memory 13 as a data table, refer to it, thereby control the current.

Further, the current actually flowing during the primary transfer from the photoconductor 1 to the intermediate transfer medium 5 is a value corresponding to the charging quantity held by the toner image, so the controller 11 may control the supply current to the transfer roller 8 using the data of the current.

As mentioned above, in this embodiment, by execution of the aforementioned control, regardless of the kind of the recording material, the effect of obtaining a high-quality image can be obtained. Further, in addition to the control method aforementioned, for example, a mode for saving the used toner amount by an instruction of a user may be able to be selected, and when the save mode is selected, the toner amount may be adjusted so as to be reduced, and the charging quantity to be given to the toner may be adjusted, and the transfer current may be controlled depending on the charging quantity held by the toner image before transfer, thus, even if the used toner amount is reduced, there can be obtained the effect that a high-quality image is obtained without deteriorating the transfer efficiency. Further, there is a case that the toner charging quantity for an excellent output should be changed depending on whether an output image is composed of only characters, only photographs, or a mixture of characters and photographs. In such a case, if the transfer current is controlled depending on the charging quantity held by the toner image before transfer, a high-quality image can be provided without deteriorating the transfer efficiency.

Further, also in the second embodiment, even if the image forming apparatus has a constitution that the four sets of the photoconductors 1Y, 1M, 1C, and 1K are arranged around the intermediate transfer medium 5 as explained in FIG. 3 and each photoconductor has one liquid developing device, the similar effect can be obtained.

Furthermore, the second embodiment, similarly to the first embodiment, can be also applied to a monochromatic image forming apparatus omitting an intermediate transfer medium as explained in FIG. 4.

Third Embodiment

Hereinafter, the third embodiment of the present invention will be explained.

In the second embodiment aforementioned, the transfer current is adjusted depending on the toner charging quantity immediately before the secondary transfer, however, the third embodiment is different in the respect that instead of adjustment of the transfer current, a charging member is installed on the surface of the recording material 9 and the charging quantity thereof is adjusted depending on the toner charging quantity. Therefore, the same numerals are assigned to the similar components to those explained in FIG. 5, and the explanation thereof will be omitted.

Figure 6:
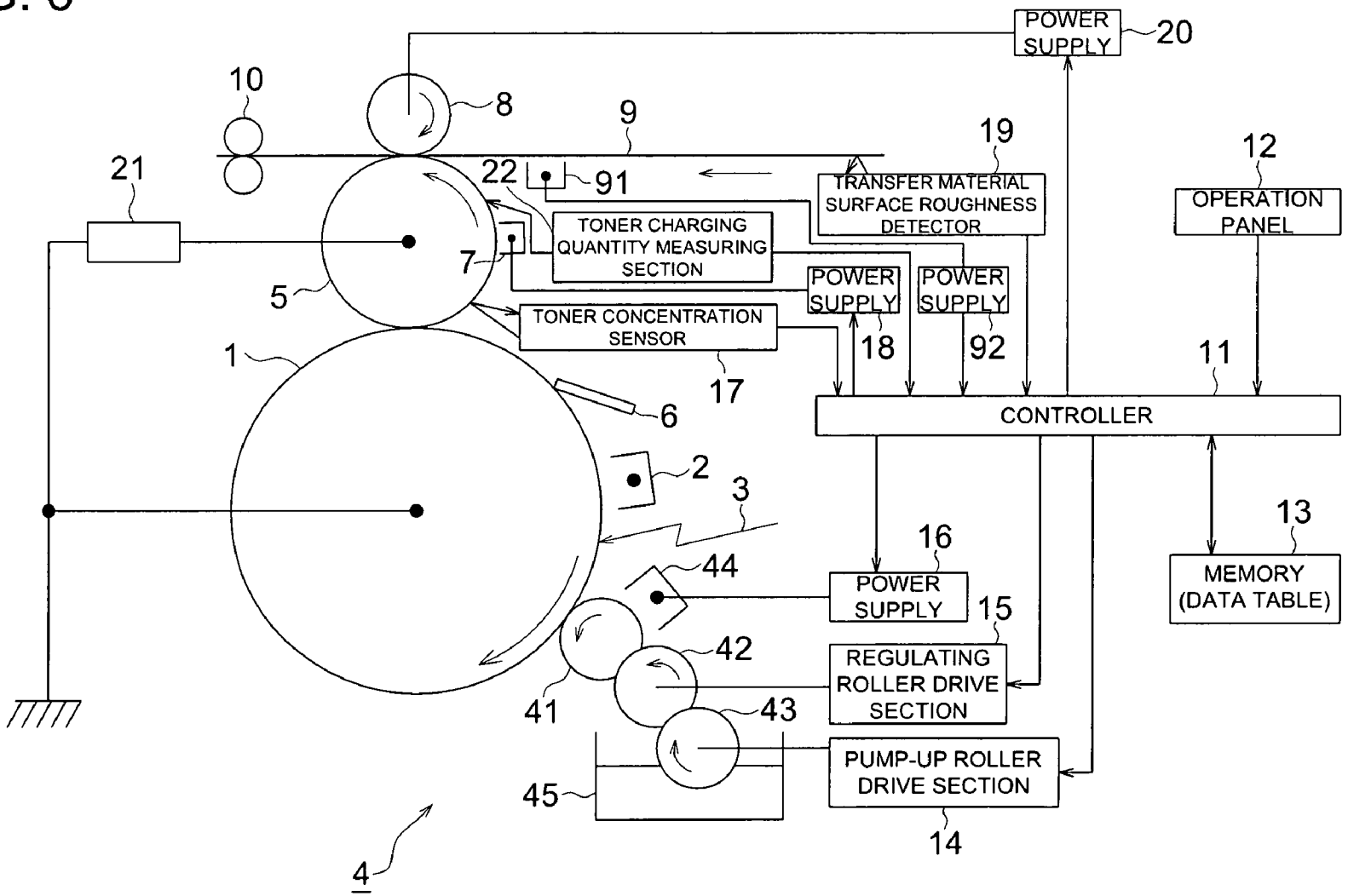
FIG. 6 is a drawing showing a schematic constitution example of the image forming apparatus according to a third embodiment of the present invention.

FIG. 6 is a drawing showing the image forming apparatus of this embodiment. At the position of the toner image formed on the intermediate transfer medium 5 before transfer to the recording material 9, an recording material charging section 91 for giving a charge to the surface of the recording material 9 is installed.

A full-color toner image formed on the surface of the intermediate transfer medium 5, when the intermediate transfer medium 5 rotates in the direction of the arrow, moves to the secondary transfer area where the intermediate transfer medium 5 and the recording material 9 make contact with each other. In the secondary transfer area, a linear pressure is applied between the intermediate transfer medium 5 and the recording material 9 by the transfer roller 8 positioned on the rear of the recording material 9 the recording material. By this linear pressure, the toner image on the intermediate transfer medium 5 is adhered closely to the recording material 9. Furthermore, a bias voltage of negative polarity is impressed to the transfer roller 8, thus to the surface of the recording material 9, a charge of reverse polarity to that of toner is fed. Furthermore, the recording material 9 entering the secondary transfer area is given the charging quantity adjusted beforehand by the recording material charging section 91 to the surface thereof.

The toner on the intermediate transfer medium 5 is tied up with the reverse-polarity charge on the surface of the recording material 9, thereby is held on the recording material 9. When the recording material 9 is conveyed in the direction of the arrow in this state and comes out from the secondary transfer area, the secondary transfer of the toner image onto the recording material 9 is completed.

In the second embodiment aforementioned, the supply current to the transfer roller 8 is adjusted, however, the adjustment range of the supply current is limited. The reason is that the limit depends on the resistances of the transfer roller, recording material, and developer, if a current exceeding the limit is intended to flow, electricity is discharged or a leak is caused at the transfer nip before transfer, therefore, the transfer efficiency is deteriorated. Particularly, in a low-humidity environment, the electric resistances of the transfer roller 8 and recording material 9 are increased, so the upper limit value of the current to be supplied to the transfer roller 8 is made smaller.

Therefore, there is installed the recording material charging section 91 for giving a charge of reverse polarity to that of toner to the surface of the recording material 9 before the toner image is transferred. As an recording material charging section 91, a general charging section such as a corona charger or a roller charger can be used. To sufficiently give a reverse-polarity charge to the surface of the recording material 9 with respect to the charging quantity Q/S per unit area held by the toner image before transfer, if the supplied quantity alone by impression of the bias voltage to the transfer roller 8 is not sufficient, the quantity for making up for the deficient quantity is given by the recording material charging section 91. When Q/S is sufficiently small, there is no need to give a charge to the surface of the recording material 9 by the recording material charging section 91, and in this case the charging quantity is set to 0 to avoid unnecessary power consumption. Further, depending on the electric resistance of the recording material, the charge is attenuated between charging the surface of the recording material 9 and arriving at the secondary transfer area, so the distance between the recording material charging section 91 and the secondary transfer area is preferably as short as possible. Further, it is preferable to make the charging quantity slightly larger compared with the deficient quantity aforementioned in expectation of the charge attenuation quantity.

As mentioned above, according to this embodiment, the toner amount and charging quantity to be given to the toner are adjusted depending on the surface roughness of the recording material 9, and the charging quantity to the surface of the recording material 9 is controlled depending on the charging quantity Q/S per unit area held by the toner image before transfer, therefore, regardless of the kind of the recording material 9, a high-quality image can be obtained.

In FIG. 6, the controller 11 functions as a toner amount adjusting section for adjusting the toner amount depending on the property of the recording material 9, a toner charging quantity controlling section for controlling the toner charging quantity by the toner charging section 44, a charge amount control portion for controlling the charging quantity by the charge applying section 7 depending on the toner amount, a transfer current controlling section for controlling the transfer current flowing through the transfer roller 8 of the transfer device depending on the charging quantity of toner before transfer, and a recording material charging controller for controlling charging the surface of the recording material 9.

The memory 13 stores the relationship between the toner amount, charging quantity to toner, transfer current, and charging quantity to the recording material depending on the kind and surface roughness of sheets as a data table. Further, the memory 13 may store outputs for toner amount adjustment depending on the kind and surface roughness of sheets, toner charging quantity adjustment, charging quantity adjustment to toner before transfer, transfer current adjustment, and charging quantity adjustment to the recording material as a table.

The toner charging quantity measuring section 22 measures the toner charging quantity of the toner image on the intermediate transfer medium 5, that is, the charging quantity of the toner immediately before it is transferred to the recording material 9, and the toner charging quantity measuring section 22 sends it to the controller 11 to reflect it to the charging quantity to the surface of the recording material 9 by the recording material charging section 91.

A power supply 92 is controlled by the controller 11 and impresses an appropriate voltage to the recording material charging section 91.

By the constitution aforementioned, the operations of adjusting the toner amount, toner charging quantity, transfer current, and charging quantity to the surface of the recording material are performed.

On the basis of the information on the sheet kind from the operation panel 12 or the surface roughness information from the recording material surface roughness detector 19, the controller 11 refers to the data table of the memory 13 and decides appropriate output to the pump-up roller drive section 14, regulating roller drive section 15, and power supply 16. By controlling those values, the toner amount on the developing roller 41 and toner charging quantity are adjusted to appropriate values depending on the kind or surface roughness of the recording material 9.

When changing the developer amount on the developing roller 41 and the output of the toner charging section 44, the toner amount on the intermediate transfer medium 5 and the charging quantity held by the toner image are changed. Depending on the toner amount, the charging quantity on the toner image by the charge applying section 7 is adjusted. Although when the adjustment is not perfect, it is desirable to adjust the transfer current. However, when improvement of the transfer rate by adjustment of the transfer current is difficult, the current or voltage to be supplied to the recording material charging section 91 for charging the surface of the recording material 9 is increased. On the basis of detection results of the toner charging quantity measuring section 17 for detecting the charging quantity per unit area held by the toner image on the intermediate transfer medium 5 using a surface electrometer, the output of the recording material charging section 91 is controlled by the controller 11.

On the other hand, it is possible to control the concerned output without using the toner charging quantity measuring section such as the surface electrometer. The reason is that when the developer amount on the developing roller 41, the output of the toner charging section 44, and the output of the charge applying section 7 are decided, the charging quantity per unit area held by the toner image on the intermediate transfer medium 5 is decided roughly. In this case, for each condition of the toner amount, output of the toner charging section 44, and output of the charge applying section 7, the supply current (voltage) conditions to the transfer roller 8 and recording material charging section 91 for realizing 100% transfer are examined beforehand, and the relationship between these is stored in the memory 13 as a data table, and it is referred to, thus the current (voltage) values are controlled.

Further, the current actually flowing during the primary transfer from the photoconductor 1 to the intermediate transfer medium 5 is a value corresponding to the charging quantity held by the toner image, so the current is measured and on the basis of the result, the output to the recording material charging section 91 may be controlled.

As mentioned above, also in this embodiment, by execution of the aforementioned control, regardless of the kind of the recording material, a high-quality image can be obtained. Further, for example, when enabling a mode for saving the used toner amount by an instruction of a user to be selected, if the mode is selected, the toner amount may be adjusted so as to be reduced, and the charging quantity to be given to the toner may be adjusted, and the supply current (voltage) to the transfer roller 8 and the supply current (voltage) to the recording material charging section 91 may be controlled depending on the charging quantity held by the toner image before transfer, thus even if the used toner amount is reduced, a high-quality image can be provided without deteriorating the transfer efficiency. Further, there may be considered a case that the toner charging quantity for excellent output should be changed depending on whether an output image is composed of only characters, only photographs, or a mixture of characters and photographs. Also in such a case, if the supply current (voltage) to the transfer roller 8 and the supply current (voltage) to the recording material charging section 91 are controlled depending on the charging quantity held by the toner image before transfer, a high-quality image can be provided without deteriorating the transfer efficiency.

Further, the third embodiment can be also applied to an image forming apparatus having a constitution that the four sets of the photoconductors 1Y, 1M, 1C, and 1K are arranged around the intermediate transfer medium 5 as explained in FIG. 3, and each photoconductor has one liquid developing device.

Furthermore, the third embodiment can be also applied, similarly to the first and second embodiments, to a monochromatic image forming apparatus omitting an intermediate transfer medium as explained in FIG. 4.

What is claimed is:

1. An image forming apparatus, comprising:

an image supporting member;

an image forming mechanism which is adapted to form an electrostatic latent image on the image supporting member;

a developing section which is adapted to develop the electrostatic latent image formed on the image supporting member with a liquid developer including a toner so as to form a toner image;

a transferring section which is adapted to transfer the toner image formed by the developing section onto a recording material;

an input portion which is adapted to input a property of the recording material;

a toner amount control portion which is adapted to control an amount of the toner of the toner image depending on the property of the recording material inputted by the input portion;

a toner amount measurement section configured to determine an amount of the toner of the toner image;

a charge applying section which is adapted to apply to the toner image, whose amount of the toner has been determined by the toner amount measurement section, a charge of opposite polarity to a charge polarity of the toner image between a developing position defined by the developing section and a transferring position defined by the transferring section;

a storing section for storing a data table defining a relationship between charges of opposite polarity to be applied by the charge applying section, and an amount of toner of a toner image;

a charge amount control portion adapted to determine an amount of the charge to be applied by the charge applying section, by referring to the data table based on the amount of the toner of the toner image, which has been determined by the toner amount measurement section; and the charge amount control portion configured to control an amount of the charge to be applied by the charge applying section so that as an amount of toner in a toner image increases, the charge applied to the toner by the charge applying section is increased.

2. The image forming apparatus of claim 1, wherein the charge applying section applies the charge to the toner image on the image supporting member.

3. The image forming apparatus of claim 1, further comprising:

an intermediate transfer member which is adapted to be transferred thereon the toner image formed on the image supporting member and to temporarily hold the toner image, wherein the charge applying section applies the charge to the toner image on the intermediate transfer member.

4. The image forming apparatus of claim 3, wherein the developing section includes a plurality of developing devices which are adapted to form a toner image of a plurality of colors, the developing devices form a plurality of toner images of different colors one by one on the image supporting member, a plurality of the toner images are superimposed on the intermediate transfer member, and the superimposed toner image is transferred onto the recording material.

5. The image forming apparatus of claim 3, wherein a plurality of sets of the image supporting members, the image forming mechanism and the developing sections are provided to form a toner image of a plurality of colors on the intermediate transfer member, a plurality of toner images of different colors are formed on the image supporting members, the plurality of toner images are superimposed on the intermediate transfer member, and the superimposed toner image is transferred onto the recording material.

6. The image forming apparatus of claim 1, wherein the charge applying section includes a corona charger.

7. The image forming apparatus of claim 1, wherein the input portion is provided on an operation panel for an operator to input a kind of the recording material.

8. The image forming apparatus of claim 1, wherein the input portion includes a detection section which is adapted to detect a roughness of the recording material.

9. The image forming apparatus of claim 1, wherein the developing section includes:

a developer supporting member which is adapted to support the developer to develop the electrostatic latent image; and a supplying section which is adapted to supply the developer to the developer supporting member, wherein the toner amount control portion controls the amount of the toner of the toner image by controlling a supply amount of the developer to be supplied by the supplying section.

10. The image forming apparatus of claim 9, wherein the supplying section includes:

a developer tank;

a pump-up roller for pumping up the developer in the developer tank; and a regulating roller for receiving the developer from the pump-up roller and supplying the developer to the developer supporting member, wherein the toner amount control portion controls a ratio of speed between the pump-up roller and the regulating roller.

11. The image forming apparatus of claim 1, further comprising: a transfer current control section which is adapted to control a transfer current supplied by the transferring section depending on the property of the recording material inputted by the input portion.

12. The image forming apparatus of claim 1, further comprising:

a recording material charging section which is adapted to apply to a surface of the recording material a charge opposite to a charge polarity of the toner image before the transfer of the toner image by the transferring section; and a recording material charging section control section which is adapted to control an amount of the charge to be applied by the recording material charging section depending on the property of the recording material inputted by the input portion.

13. A method of forming an image, comprising the steps of:

forming an electrostatic latent image on a image supporting member;

forming a toner image at a developing position defined by a developing section by developing the electrostatic latent image formed on the image supporting member with a liquid developer including a toner;

transferring the toner image onto a recording material at a transferring position defined by a transferring section;

judging a property of the recording material;

controlling an amount of the toner of the toner image depending on the property of the recording material;

determining an amount of the toner of the toner image;

applying to the toner image whose amount of the toner has been determined in the step of determining an amount of the toner of the toner image, between the developing position and the transferring position, a charge opposite to a charge polarity of the toner image;

determining the amount of charge to be applied to the toner image, by referring to a data table defining a relationship between charges of opposite polarity to be applied to the toner image, and an amount of toner of a toner image; and controlling the charge to be applied to the toner image depending on the amount of the toner of the toner image so that as an amount of toner in a toner image increases, the charge applied to the toner by the charge applying section is increased.

* * * * *